US009914236B2

(12) United States Patent
Machamer

(10) Patent No.: US 9,914,236 B2
(45) Date of Patent: Mar. 13, 2018

(54) CUTTING SYSTEM AND ANVIL STRIP MOUNTING APPARATUS AND METHOD

(71) Applicant: Tamarack Products, Inc., Wauconda, IL (US)

(72) Inventor: David E. Machamer, Wauconda, IL (US)

(73) Assignee: TAMARACK PRODUCTS, INC., Wauconda, IL (US)

( * ) Notice: Subject to any disclaimer, the term of this patent is extended or adjusted under 35 U.S.C. 154(b) by 95 days.

(21) Appl. No.: 15/060,248

(22) Filed: Mar. 3, 2016

(65) Prior Publication Data

US 2016/0279821 A1 Sep. 29, 2016

Related U.S. Application Data

(60) Provisional application No. 62/139,128, filed on Mar. 27, 2015.

(51) Int. Cl.
*B26D 1/22* (2006.01)
*B26D 1/62* (2006.01)
(Continued)

(52) U.S. Cl.
CPC ..... *B26D 7/265* (2013.01); *B26D 1/22* (2013.01); *B26D 1/36* (2013.01); *B26D 1/385* (2013.01);
(Continued)

(58) Field of Classification Search
CPC . B26D 1/22; B26D 1/36; B26D 1/385; B26D 1/626; B26D 7/20; B26D 7/265; Y10T 83/0515; Y10T 83/4795; Y10T 83/483; Y10T 83/4838; Y10T 83/9312; Y10T 83/4844; Y10T 83/793; Y10T 83/9309
See application file for complete search history.

(56) References Cited

U.S. PATENT DOCUMENTS 4,244,251 A * 1/1981 Iwao ..... B26D 1/385 83/349
5,359,915 A * 11/1994 Hitz ..... B26D 1/385 83/342
(Continued)

FOREIGN PATENT DOCUMENTS

GB 2268924 A * 1/1994

*Primary Examiner* — Stephen Choi
(74) *Attorney, Agent, or Firm* — Greer Burns & Crain, Ltd

(57) ABSTRACT

A method for cutting a moving source material including: rotating a cutting cylinder including a blade; positioning a structural member in spaced relation from the cutting cylinder, wherein the space between the cutting cylinder and the structural member receives the source material; and positioning an anvil in the space. The anvil engages the source material when it is displaced between the cutting cylinder and the structural member. The method also includes: directing the blade into contact with the source material, whereupon the source material is pressed against the anvil and is severed by the blade, and the anvil is displaced by the cutting blade from a first retracted position to a second activated position; and applying an increasing biasing force to the moving anvil as it is displaced toward the second activated position so as to direct the anvil back to its first retracted position.

11 Claims, 11 Drawing Sheets

(51) Int. Cl.

| | |
|---|---|
| ***B26D 7/26*** | (2006.01) |
| ***B26D 7/20*** | (2006.01) |
| ***B26D 1/36*** | (2006.01) |
| ***B26D 1/38*** | (2006.01) |

(52) U.S. Cl.
CPC ..... *B26D 1/626* (2013.01); *B26D 7/20* (2013.01); *Y10T 83/0515* (2015.04)

(56) References Cited

U.S. PATENT DOCUMENTS

| | | | | |
|---|---|---|---|---|
| 6,772,663 | B2 | 8/2004 | Machamer | |
| 7,901,533 | B2 | 3/2011 | Steidinger | |
| 2004/0022465 | A1* | 2/2004 | Fish ..... | F16C 23/045<br>384/192 |
| 2011/0245056 | A1 | 10/2011 | Machamer et al. | |

* cited by examiner

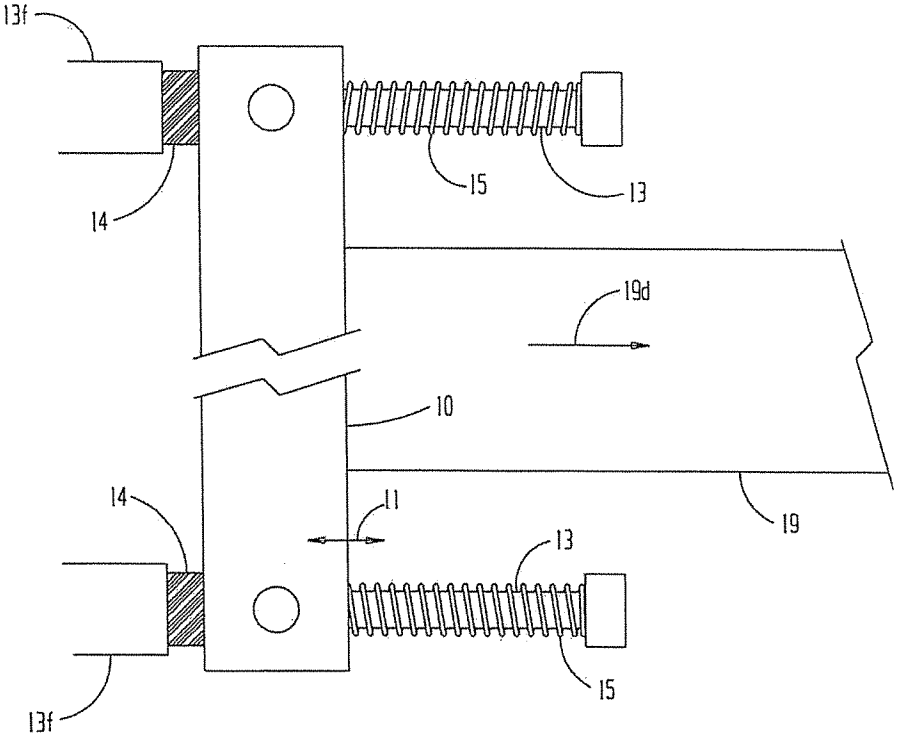
PRIOR ART FIG 1B
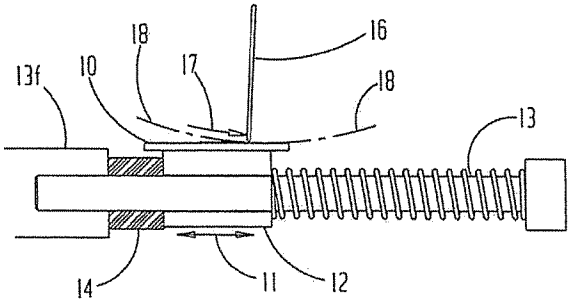
PRIOR ART FIG 1A

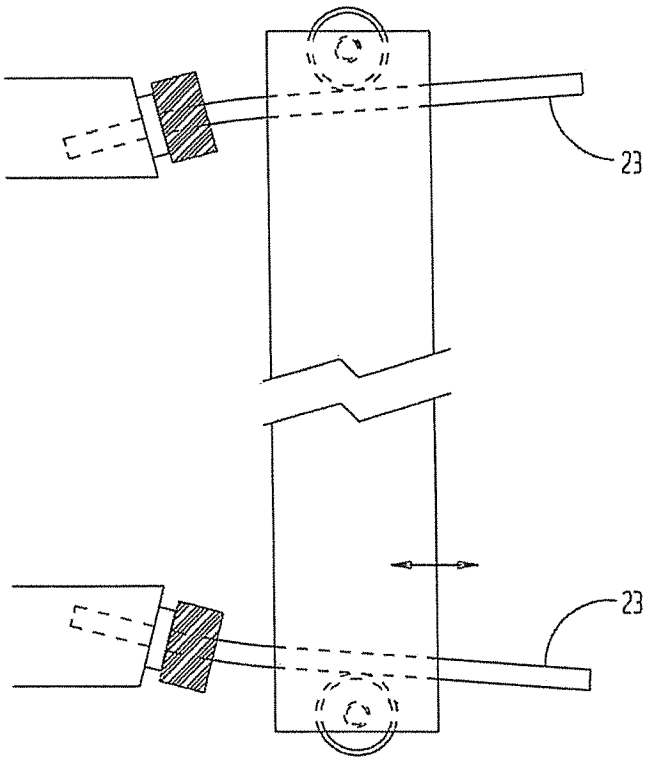
PRIOR ART FIG 2B
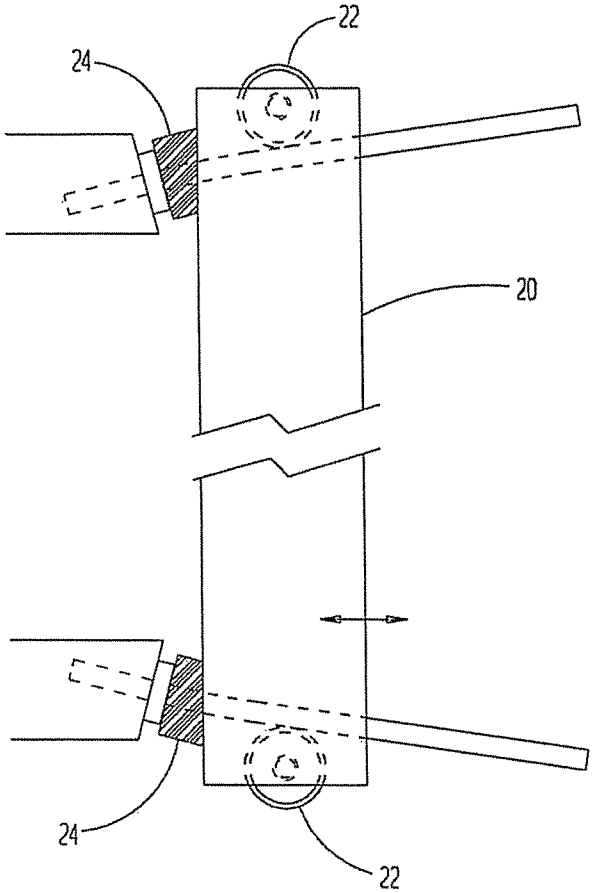
PRIOR ART FIG 2A

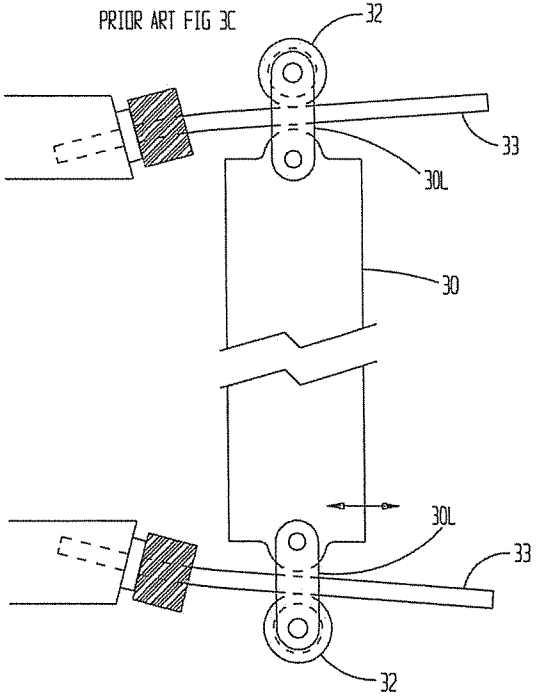
PRIOR ART FIG 3C
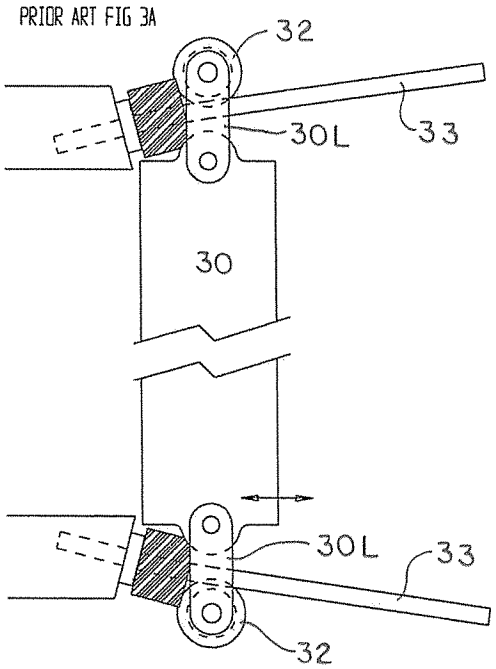
PRIOR ART FIG 3A
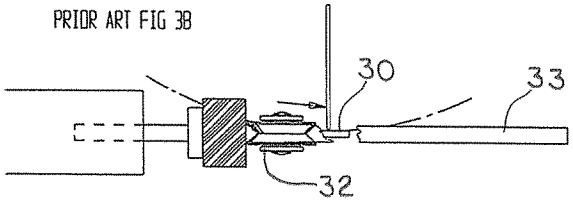
PRIOR ART FIG 3B 52
53f
53
49
50
53
52
53f 53f
53
50
52
53
53f
52

53f
53
53
50
53
53
53f
53f 53f
52
53
53
50
53f 53f
52
53
53
53f
53f
53
50
53
53f
52

53
53g
53
50
53f
53f
52

CUTTING SYSTEM AND ANVIL STRIP MOUNTING APPARATUS AND METHOD

RELATED APPLICATION

The present application claims 35 USC 119(e) priority from U.S. Provisional application Ser. No. 62/139,128 filed Mar. 27, 2015.

FIELD OF THE INVENTION

The present invention relates generally to apparatus and method for cutting paper and thin films using a moveable, reciprocating anvil strip, and is more particularly directed to an improved anvil displacement and position control arrangement used in the rotary cutting of a linearly displaced thin paper or film to form individual flat sheets.

BACKGROUND OF THE INVENTION

The Tamarack® Vista® applicator is a commercial product used to feed, cut, and apply paper and thin film materials to folding cartons. The Vista applicator applies window patches over a die cut opening in a folding carton, and it may also apply labels, microwave susceptor patches, RFID inlays, release liner, reinforcing patches and other materials onto folding cartons, sheets of paper, or corrugated paperboard. The Tamarack Vista is disclosed in U.S. Pat. No. 6,772,663 particularly in relation to FIGS. 4, 5A and 5B; in U.S. Pat. No. 7,901,533 particularly in relation to FIGS. 10 and 11; and in U.S. patent application Ser. No. 12/751,014 particularly in relation to FIG. 1. The disclosures in the aforementioned published documents are hereby incorporated by reference in the present application in their entirety.

The Vista applicator utilizes a blade or blades mounted in a rotary cutting cylinder. The material to be cut is pinched between the blade tip and an anvil strip which rides atop a vacuum belt, or belts. The anvil surface is typically a thin, hardened, flat steel surface. As the cutting blade contacts the essentially stationary anvil strip, the blade pushes the anvil strip slightly 'downwards', i.e., away from the blade, into contact with a typically moving belt surface, and the resulting friction force between the moving belt and the anvil strip accelerates the anvil strip. The tangential component of the motion of the blade tip contacting the anvil strip also accelerates the anvil strip. After the material to be cut is severed between the blade tip and the anvil strip, the blade tip, following the cutting blade's rotary path, breaks contact with the anvil strip. The anvil strip is then propelled back towards its initial position by a spring force provided by coil springs. Every cutting cycle thereby imparts a cyclic, reciprocating motion to the anvil strip.

In prior art Vista® applicators, the anvil strip rode atop a portion of the vacuum belts where the belts traveled in a straight path. The anvil strip was guided in this straight path by steel rods. In a subsequent version of the Vista applicator, the vacuum belt section was redesigned to provide two separate belt sections. The upper, or infeeding, belt section was driven by its own servo motor and programmed to provide stop-and-go infeeding, just as the feed cylinder provided stop-and-go feeding of the film. This change allowed a reduction in the infeeding tension on the material to be cut which was beneficial for accurately feeding 'stretchy' materials (those with a relatively low modulus of elasticity) such as polyethylene and latex rubber. The lower, or outfeeding, belt section was driven by its own servo motor at an essentially constant speed that followed the conveyor or carrier belt speed of the host carton folder/gluer machine. The outfeeding belt section then conveyed the cut piece of film to be joined onto a carton blank, or the like.

With two belt sections, there resulted a 'gap' between the two sections. In order to minimize the 'gap' between upper and lower belt sections that the film was fed through, it was desirable to locate the anvil strip over a curved portion of the lower, or outfeeding, belt path. It thereby became desirable to provide a curved reciprocating path for anvil strip transit. The anvil strip itself was also shaped into a curve relative to its end view section to comply with the curved portion of the belt path.

Other changes to the lower belt section reduced space between the belts. As the belts support the anvil strip, the reduced space between the belts allowed for the use of a thinner anvil strip, while still providing sufficient rigidity to effectively resist the cutting forces. A thinner anvil strip also reduces reciprocating forces allowing the use of lighter springs and guides. Reduced reciprocating forces also reduces wear on the blade tip and potentially allows for higher process speeds.

Occasionally, the cutting process may be interrupted by: (1) a jam-up, i.e., material may undesirably accumulate in the cutting area due to the lead edge of the material getting caught or obstructed; (2) a blade failing to complete a cut; or (3) adhesive buildup on moving parts causing the film to stick, or other mechanical failures. The anvil strip was provided with intentionally weakened mounting parts to allow the anvil strip to break-away in the event of a jam-up. However, these parts could still be damaged in a jam-up.

SUMMARY OF THE INVENTION

In the present invention, an improved anvil strip mounting arrangement provides a more secure way of mounting the anvil strip to allow longer periods of operation without interruptions from anvil strip mounting failures. The improved anvil strip mounting allows the anvil strip to follow a curved surface and reduces the possibility that the material being cut might become trapped under the anvil strip and interrupt the cutting process. In the event of a jam-up, it is desirable that the anvil strip be moved out of the way of the severed piece of material so that it does not become damaged by the jammed material or rotating cutting blades.

Replacing the prior-art slide rods and guide blocks with deflectable, contoured leaf springs allows the spring force and anvil strip travel path to be readily customized by changing various contours and dimensions to provide the desired material cutting performance results.

A variable and progressive spring rate allows the anvil strip to accelerate more quickly during initial contact with the blade tip which reduces blade tip wear, while providing an increased return force after the cut which reduces anvil strip travel time as well as the cutting cycle time, which increases the operating speed of the rotary cutting machine. This reduces the over-travel of the anvil strip which also reduces cycle time and increases operating speeds.

The inventive leaf spring support and displacement arrangement provides not only the force to return the anvil strip to its retracted, or starting, position, but also tensions the anvil strip. A thinner and more flexible anvil strip has been shown to oscillate and come out of contact with the belts, undesirably allowing the material being cut to get caught underneath the anvil strip instead of flowing over the top of the anvil strip. The present invention allows more tension to be applied to the anvil strip to reduce the amplitude of anvil strip oscillations which allows for higher operating speeds without interruptions in the cutting process, such as caused by jam-ups.

The present invention also provides relatively low friction anvil strip mounting via semi-spherical guide rollers supported by small ball bearings. The semi-spherical guides also stabilize the motion path of the anvil strip with remarkably low friction compared to earlier slide block mounts.

In summary, the advantages of the invention over the prior art include:

- Reduced mass parts allowing for higher reciprocating rates with the potential for increased processing speeds.
- Reduced mass parts also require less force to initiate motion which reduces scrubbing wear of the tip of the cutting blade.
- The path of the anvil strip can be readily defined and controlled by the contour of side plates.
- Side plates provide for significantly greater tensioning of the anvil strip which reduces the amplitude of anvil strip oscillations.
- Side plates also provide greater accuracy and consistence in the over-travel positioning accuracy of the anvil strip which accommodates jam-ups without damage to components.
- Ball bearings reduce friction compared to prior sliding rods, which reduces the force needed to initiate anvil strip motion while reducing scrubbing wear on the tip of the cutting blade.
- Spherical or semi-spherical rollers provide a low friction guiding interface with guide rollers, where the shape of the rollers may be modified to vary pitch-mode stabilization of the anvil strip.

OBJECTS OF THE INVENTION

Accordingly, it is an object of the present invention to provide faster, more reliable and more accurate die cutting of a strip of flexible material into plural sheets of equal size.

Yet another object of the present invention is to reduce the mass of moving components in a high speed rotary pressure cutter for increasing the pressure cutter's operating speed, durability and reliability, as well as the precision and accuracy in positioning the pressure cutter's blade in reducing a continuous strip of material into plural individual sheets.

Still another object of the present invention is to reduce the friction in a high speed rotary pressure cutter for increasing the cutter's operating lifetime, while stabilizing the motion of its components and reducing the possibility of interruptions in operation.

A still further object of the present invention is to facilitate loading of the anvil in a high speed rotary pressure cutter.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1A is a simplified schematic side view of prior art anvil strip and its mounting;

FIG. 1B is a simplified schematic top view of prior art anvil strip and mounting;

FIG. 2A is a simplified schematic top view of another prior art anvil strip and mounting shown in a retracted position;

FIG. 2B is a simplified schematic top view of the prior art anvil strip and mount of FIG. 2A shown in an activated position;

FIG. 3A is a simplified schematic top view, retracted position of an alternate embodiment of the prior art anvil strip and mount of FIG. 2A;

FIG. 3B is a simplified schematic end view, retracted position of an alternate embodiment of the prior art anvil strip and mounting of FIG. 3A;

FIG. 3C is a simplified schematic top view, activated position of an alternate embodiment of FIG. 3B;

DETAILED DESCRIPTION OF THE PREFERRED EMBODIMENTS OF THE INVENTION

Figure 4D:
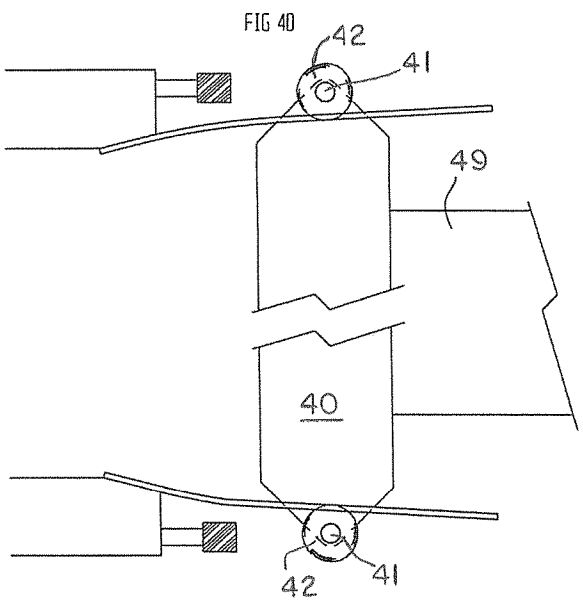
FIG. 4D is a simplified schematic top view, activated position of an inventive embodiment of the anvil strip and mounting/guiding components.

FIGS. 1A and 1B illustrate a prior art anvil strip and mounting system. The anvil strip 10 is configured to reciprocate in the direction noted by arrow 11 since the anvil strip 10 is mounted on slide blocks 12 which are free to slide on slide rods 13 which are rigidly supported by frame member 13*f*. In FIGS. 1A and 1B, the anvil strip 10 is shown in a retracted position where it's leftwards travel is limited by stops 14 and is preloaded in the retracted position by springs 15. Please note that terms: left, right, up, down, etc., are selected to simplify and illustrate the various mechanisms and methods and are not intended to limit this disclosure.

Anvil strip 10 is propelled in a rightward direction when cutting blade 16, which is mounted in a rotating cutting cylinder (not shown), contacts the anvil strip 10 as in FIG. 1A. The rotational direction of the cutting blade 16 is illustrated by the arrow 17 and the portion of the swing of blade 16 is further indicated by phantom line 18.

To simplify the drawings, the material to be cut, such as poly, paper, metallic, rubber, etc., films is not shown in FIG. 1A or 1B, but would be pinched between the tip of blade 16 and anvil strip 10.

As the blade 16 tip pinches the material to be cut, it further presses down on anvil strip 10 which presses anvil strip into contact with vacuum belt, or belts, 19 which travel in a direction shown by arrow 19*d*. This tends to accelerate anvil strip 10 in a rightwards direction, as does the horizontal component of the tangential motion of blade 16 tip. Anvil strip 10 is preferably comprised of steel, carbon fiber composite material, or a combination of steel/cushion/steel, steel/carbon fiber composite or of anvil strips with coatings such as of chromium by Armoloy of DeKalb, Ill., titanium carbide, titanium nitride, or ceramic by CemeCon Inc. of Horseheads, N.Y., or diamond by Diamond Tool Coatings LLC of North Tonawanda N.Y.

The pressure between blade 16 tip and anvil strip 10 severs the material to be cut (again, not shown). Once the material to be cut is severed, the blade 16 continues its rotation on path 18 and the bladetip moves upwards and reduces its force on anvil 10 and then comes out of contact with anvil strip 10. The springs 15 having been further compressed by the motion of anvil strip 10 which push the anvil 10 to the left and back into contact with the stops 14 in a first retracted position as shown in FIGS. 1A and 1B. In a typical Vista window applicator machine at normal operating speed, the total travel of anvil strip 10 may be approximately ⅜". There are typically some left-right oscillation as the anvil assembly bounces off the stops 14. There may also be some upwards oscillation of the anvil 10 as it comes out of contact with belts 19. The anvil strip of prior art embodiments, however, is relatively thick (typically 0.028"-0.042") and rigid and so undergoes limited vertical oscillation.

A metal anvil strip 10 is contemplated for use in most intended applications for the rotary pressure cutting apparatus of the present invention. However, the present invention is not limited to use of a metal anvil strip, as other compositions of the anvil strip such as high strength, high impact multi-layer laminates or coatings of ceramic or carbon fiber materials could be used for various applications.

FIGS. 2A and 2B illustrate a further prior art embodiment which has two ball bearings 22 that replace the slide blocks 12 of FIGS. 1A and 1B and two rods 23 loaded in a bending mode that replace the coil springs 15 in FIGS. 1A and 1B. The anvil strip 20 is connected to the two ball bearings 22 such as those provided by VXB.com Ball Bearings of Anaheim, Calif. that have a 'V' or 'U' groove in the outer race so that the bearings 22 stay engaged with rods 23. The rods may be initially installed at a divergent angle as shown in FIG. 2A. The anvil strip 20 and bearings 22 are sized so that when installed on the rods, the rods bend elastically creating a tension on the anvil strip 20. When the blade (not shown) engages the anvil strip 20 and presses it into contact with the vacuum belts (not shown) in a manner similar to that described above in conjunction with FIGS. 1A and 1B, the anvil strip 20 is driven to the right. Due to the divergent angle of the rods, the rods are bent further as the anvil strip 20 moves to the right as shown in FIG. 2B and this increases tension in the anvil strip 20. After the cut, as the blade rotates upwards from the anvil strip, the tension in anvil strip 20 and the geometry of the divergent rods 23 cause the anvil strip 20 to reciprocate back leftwards to its initial position shown in FIG. 2A until anvil strip 20 contacts stops 24. This embodiment provides reduced friction and reduced reciprocating mass in comparison to the apparatus shown in FIGS. 1A and 1B, which allows for increased reciprocating rates and higher operating speeds.

FIGS. 3A, 3B, and 3C illustrate a further prior art embodiment very similar in concept to FIGS. 2A and 2B, however, the anvil strip 30 is attached differently to the ball bearings such as with a pair of links 30L. In one commercial embodiment, links 30L were a simple nylon tie-strap such as provided by Thomas & Betts of Memphis, Tenn. which was routed through the ball bearing 32 and a hole in each end of the anvil strip 30. The tie wraps 30L also provided a 'fuse' effect where one or both tie wraps 30L would break or sever in the case of a jam-up and allow the anvil strip 30 to be ejected with less likelihood of damage to the spring rods 33 or anvil strip. In practice, the tie straps 30L tended to fail regularly as the reciprocating motion caused edges of anvil strip 30 to gradually cut through the tie wraps 30L. Also the tie wraps 30L were rather small and difficult for operators to replace properly.

Figure 4C:
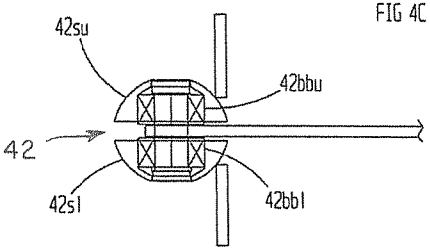
FIG. 4C is a simplified schematic front view of an inventive embodiment of the anvil strip and mounting/guiding components.
Figure 4A:
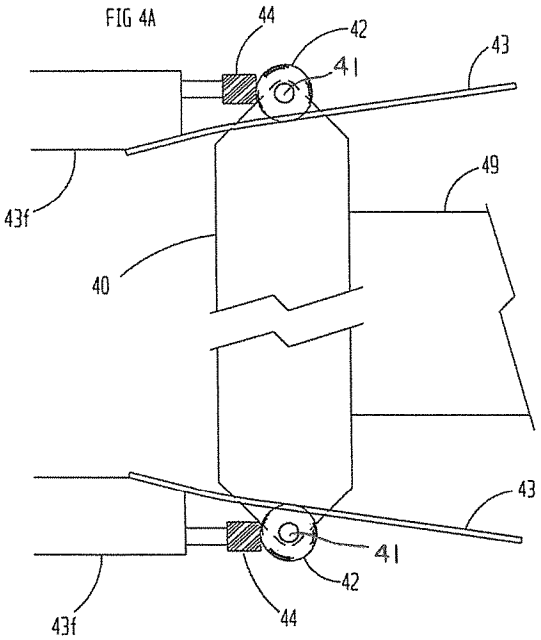
FIG. 4A is a simplified schematic top view, retracted position of an inventive embodiment of the anvil strip and mounting and guiding components.
Figure 4B:
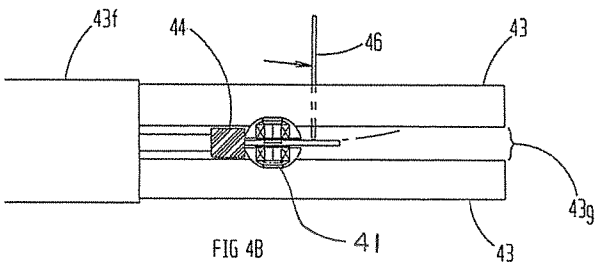
FIG. 4B is a simplified schematic end view, retracted position of an inventive embodiment of the anvil strip and mounting and guiding components.

FIGS. 4A, 4B, 4C, and 4D illustrate an improvement of the anvil strip mounting in accordance with one embodiment of the present invention. Anvil strip 40 is equipped with a bearing assembly 42 at each end. Bearing assembly 42 is comprised of an upper ball bearing 42*bbu* mounted in a semispherical roller 42*su* and lower ball bearing 42*bbl* mounted in a semispherical roller 42*sl* as shown in FIGS. 4B and 4C. The upper and lower assemblies are fastened onto anvil 40 via a small screw, or pivot pin, 41 from top and bottom into an axle, screw and nut, rivet, or the like. Relative motion is between a semispherical roller and its associated pivot pin.

The bearing assemblies support and guide the anvil strip 40 in a track or groove 43*g* created by the space between cantilever springs 43. Springs 43 are rigidly supported by frame members 4*f*.

FIGS. 4A and 4B show the anvil strip 40 in a retracted position just as blade 46 is rotating into contact with anvil 40 to initiate a rightwards motion in anvil strip 40. The motion is resisted by the diverging cantilever springs 43, which bend further inwardly as the anvil strip moves to the right as seen in FIG. 4D. After the blade 46 rotates upwards and out of contact with the anvil strip 40, the anvil strip is free to retract leftwards until it contacts stops 44. The return force can be adjusted by providing stiffer or weaker leaf springs, which have been constructed from 0.015" thick spring steel, but could be thicker or thinner, or by adjusting the relative length of the leaf springs 43 in relation to the retracted position of the anvil strip 40 relative to frame members 43*f*.

Figure 4E:
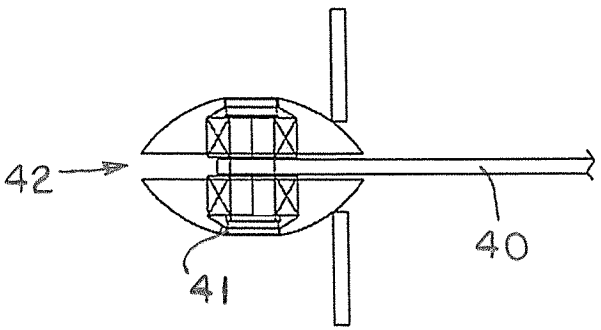
FIG. 4E is a simplified schematic side view of the inventive guide roller assembly with a revised contour for improved pitch-mode anvil strip stability.

The contour of rollers 42*su* and 42*sl* may be selected to provide varying amounts of guiding relative to the slot or gap 43*g*. For example, a flatter, or more 'squashed', roller assembly 42*a*, as seen in FIG. 4E, will provide more anvil strip horizontal stability and guiding relative to pitch than a more spherical roller assembly. Conversely, a more spherical roller assembly allows the anvil strip to rotate, i.e., change pitch, more easily such as shown in FIGS. 4B and 4C for bearing assembly 42.

Figure 5D:
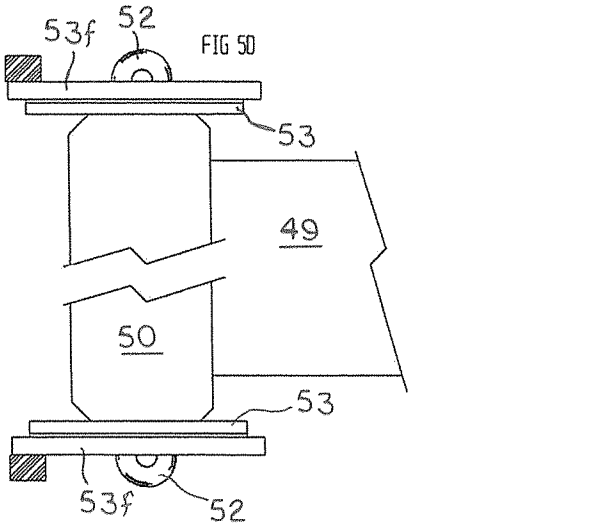
FIG. 5D is a simplified schematic top view, activated position of an alternate inventive embodiment of the anvil strip and mounting/guiding components.
Figure 5A:
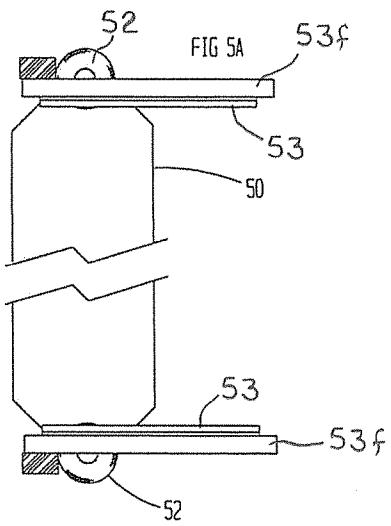
FIG. 5A is a simplified schematic top view, retracted position of an alternate inventive embodiment of the anvil strip and mounting/guiding components.
Figure 5F:
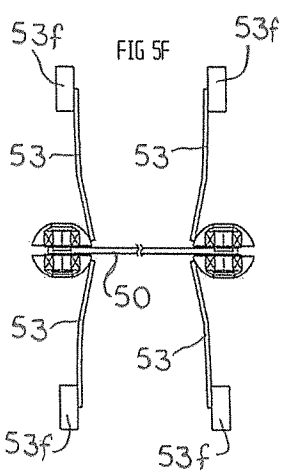
FIG. 5F is a simplified schematic front view, activated position of an alternate inventive embodiment of the anvil strip and mounting/guiding components.
Figure 5E:
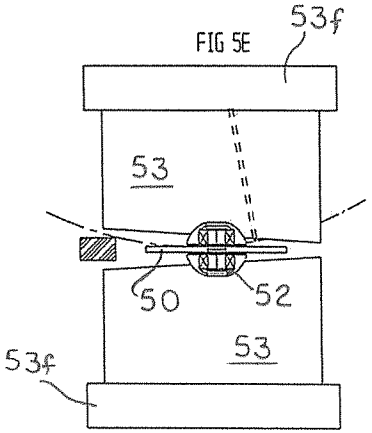
FIG. 5E is a simplified schematic end view, activated position of an alternate inventive embodiment of the anvil strip and mounting/guiding components.
Figure 5C:
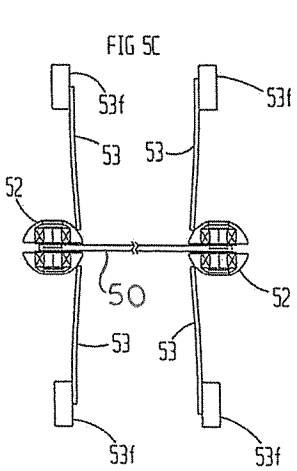
FIG. 5C is a simplified schematic front view, retracted position of an alternate inventive embodiment of the anvil strip and mounting/guiding components.
Figure 5B:
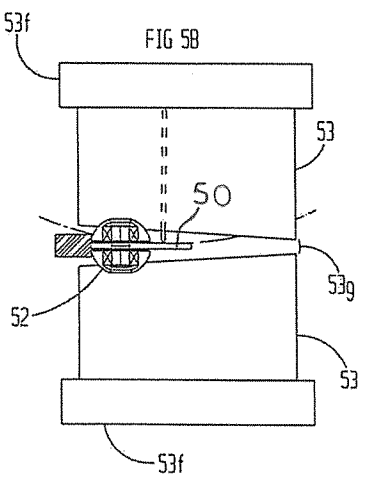
FIG. 5B is a simplified schematic end view, retracted position of an alternate inventive embodiment of the anvil strip and mounting/guiding components.

FIGS. 5A, 5B, 5C, and 5D illustrate a further inventive embodiment of the anvil strip 50 mounting. FIGS. 5A, 5B, and 5C illustrate the anvil strip 50 in a retracted position. A vacuum belt 49 is shown in FIG. 5D. FIGS. 5D, 5E and 5F illustrate the anvil strip 50 in an activated position, i.e., during or after a cut has occurred. Roller assemblies 52 are very similar in construction to roller assemblies 42 shown in FIGS. 4A-4E. Cantilever springs 53 are supported by frame members 53*f*. Springs 53 may be contoured in the manner shown in FIGS. 5B and 5E, i.e., to provide a converging gap. The gap 53*g* guides the rollers 52 and consequently the anvil strip 50. The converging gap 53*g* causes additional spring deflection and tension in the anvil strip 50 as the anvil strip is cycled to the right. The additional spring deflection is shown in FIG. 5F. This increasing spring force thus acts to drive the spring to the left during and after a cut as described previously. A progressively increasing spring force could also be provided by mounting the springs 53 so that they diverge in the top view (such as FIG. 5D) so that as anvil strip 50 moves to the right, the springs 53 are increasingly directed more inwardly towards one another.

Figure 6A:
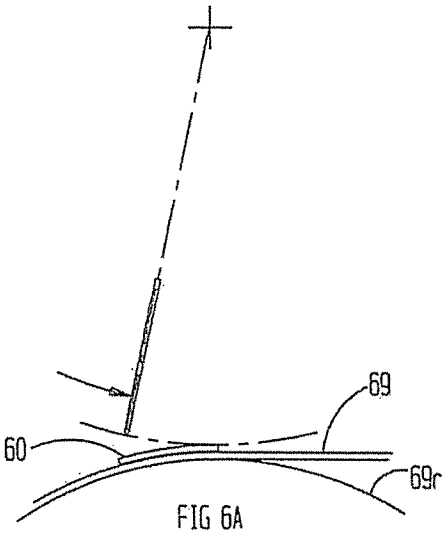
FIG. 6A is a simplified schematic side view of the anvil strip working in conjunction with a blade, belt, and cylinder.
Figure 6B:
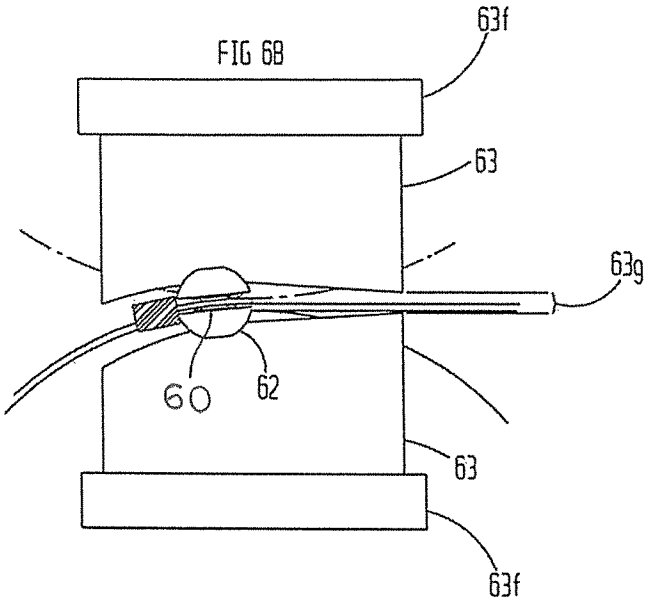
FIG. 6B is a simplified schematic side view of a further inventive embodiment of the anvil strip and mounting/guiding components in a retracted position and working in conjunction with a blade, belt, and cylinder.
Figure 6C:
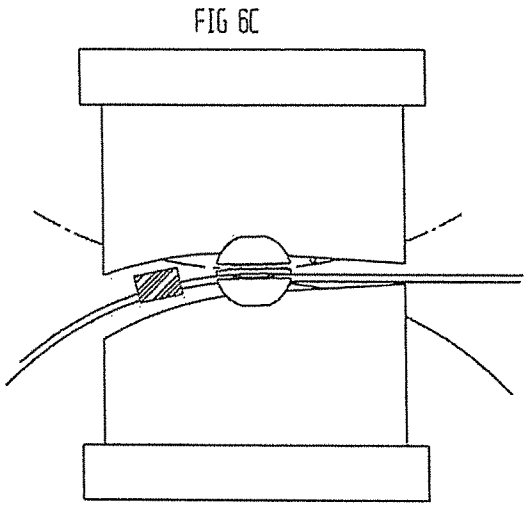
FIG. 6C is a simplified schematic side view of a further inventive embodiment of the anvil strip and mounting/guiding components in an activated position and working in conjunction with a blade, belt, and cylinder.

FIGS. 6A, 6B, and 6C show a further alternative embodiment similar to the embodiment of FIGS. 5A-5F. FIG. 6A schematically shows an anvil strip 60 supported on top of a vacuum belt or belts 69 on a portion of the belt routing where the belt 69 is supported on a roller 69*r*. In FIG. 6B the anvil strip 60 is in a retracted position and the roller assemblies 62 are in an expanded, or radius, portion of gap 63*g*. As the anvil strip 60 is cycled through its normal working motion, towards the right, the roller assemblies transition to a straight, linear portion of gap 63*g*. Thus, the anvil strip 60 can transition from a curved path to a straight path, and vice versa, to follow the top surface of belt or belts 69. Similar to FIGS. 5A-F, the spring deflection can be increased as the anvil strip 60 moves to the right either by converging the gap 63*g*, diverging the springs 63 as seen from the top (a top view is not shown for FIG. 6), or a combination of both techniques.

Figure 7B:
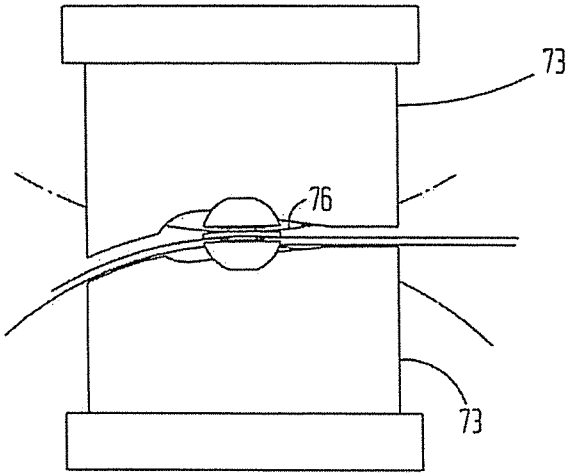
FIG. 7B is a simplified schematic side view of a further inventive embodiment of the anvil strip and mounting/guiding components in an activated position and working in conjunction with a blade, belt, and cylinder.
Figure 7A:
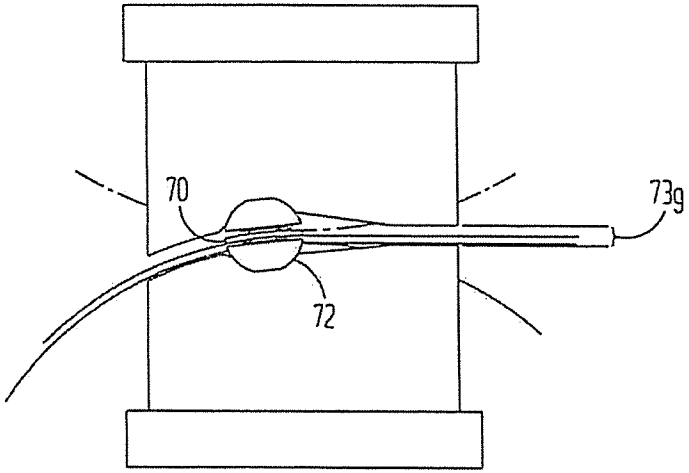
FIG. 7A is a simplified schematic side view of a further inventive embodiment of the anvil strip and mounting/guiding components in a retracted position and working in conjunction with a blade, belt, and cylinder.

FIGS. 7A and 7B show an enhanced embodiment of the invention. FIG. 7A shows anvil strip 70 in a retracted position and FIG. 7B shows anvil strip 70 in an activated position. The gap 73*g* is wider in the range of desired travel and narrow beyond the normal range. This gap configuration allows the normal range of motion to be defined and travel beyond that range substantially increases the spring force serving to return anvil strip 70 back to its normal range of motion. In this way, a jam-up, which may tend to drive the anvil strip 70 further to the right than normal, allows the anvil strip 70 to over-travel its normal range of motion, while reducing the likelihood of damage to the anvil strip 70 and its associated mountings. In the event of an over-travel, when the roller assemblies are in a narrower, parallel portion of the gap 73*g*, the anvil strip may be in a quasi-stable position, where it will remain until manually or otherwise reset in its normal range of travel. This permits the anvil strip 70 to remain out of the way of rotating blade path 76 when a jam-up occurs.

Figure 8B:
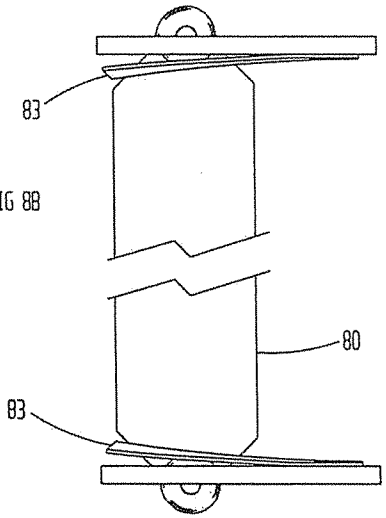
FIG. 8B is a simplified schematic top view of a further enhanced inventive embodiment of the anvil strip and mounting/guiding components in a retracted position.
Figure 8A:
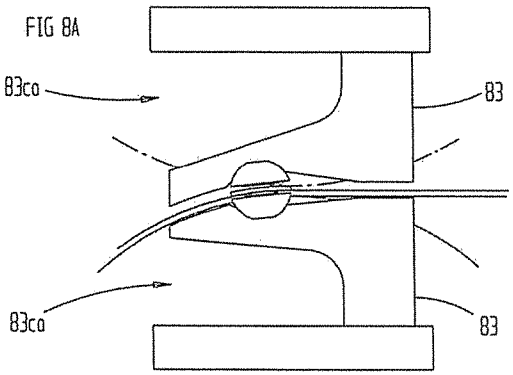
FIG. 8A is a simplified schematic side view of a further enhanced inventive embodiment of the anvil strip and mounting/guiding components in a retracted position and working in conjunction with a blade, belt, and cylinder.

FIGS. 8A and 8B illustrate a still further enhanced embodiment of the invention. FIG. 8A shows a refined version of springs 83. Springs 83 include the enhanced groove configuration of springs 73 shown in FIGS. 7A and 7B and, in addition, include a revised outer contour that provides a varying spring rate. For example, the right side of springs 83 has a stiffer spring rate than the left side of spring 83 as shown in FIG. 8A. The spring rate may be varied by the amount and shape of the cut away portions 83*ca*. This allows the activating and return forces to be tuned by the machine builder and for that matter by the end user. The machine builder can stock springs 83 with various contours to provide for different speed ranges and cutting conditions. Similarly, the springs may be supplied in different thicknesses to provide different spring rates. The different spring thicknesses can be supplied in a single thickness or additional thicknesses can be stacked in the manner of a leaf spring to substantially alter the spring rate in controlling the position of the anvil strip 80.

Figure 9A:
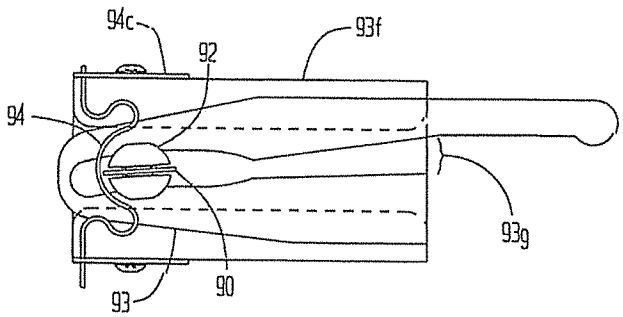
FIG. 9A is a schematic side view of a commercial embodiment of the invention showing the anvil strip in a retracted position.

FIGS. 9A-D show a simplified schematic view of a commercial embodiment of the inventive anvil strip arrangement. The anvil strip assembly 90, with anvil strip and semispherical bearings 92 is installed in the gap 93*g* in the spring 93 using an installation tool 90*t* at each end of the anvil strip assembly. The spring 93 is designed to allow relatively convenient and safe access to the gap 93*g*. Tool 90*t* is used to push the anvil strip 90 into the gap 93*g* into a retracted position as shown in FIG. 9A. Tool 90*t* may also include a hooked end so that it can also be used to pull and/or remove the anvil strip assembly 90 out of the gap 93*g*.

In the retracted position shown in FIG. 9A, a partially 'looped' belt 94 provides a stop which engages the semispherical bearing assembly 92 on each end of the anvil strip 90. Belt 94 may be adjusted to define the retracted position of anvil strip assembly 90 by varying the length of belt captured between aperture flanges 94*c*. In FIG. 9A, when the anvil strip assembly 90 is stopped by the belt 94 in the retracted position, the semispherical bearing 92 will be in contact with belt 94, however for clarity, this contact is not shown in FIG. 9A.

Figure 9B:
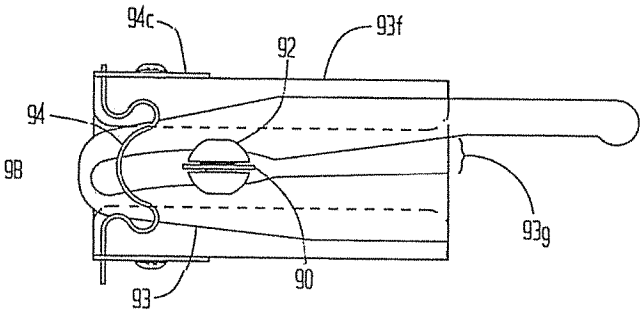
FIG. 9B is a schematic side view of a commercial embodiment of the invention showing the anvil strip in an activated position.

The anvil strip assembly 90 is shown in an activated position in FIG. 9B, where the blade (not shown) has caused the anvil strip assembly 90 to move towards the right as described previously herein.

Figure 9C:
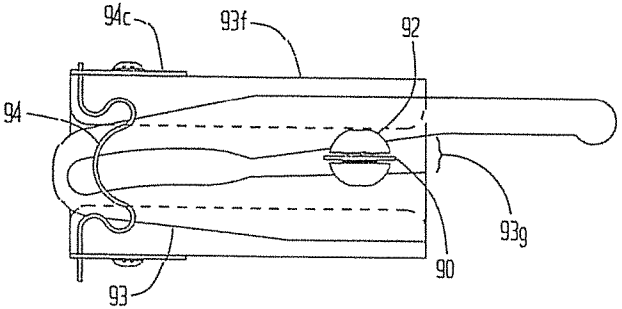
FIG. 9C is a schematic side view of a commercial embodiment of the invention showing the anvil strip in a quasi-static 'kicked-out' position.
Figure 9D:
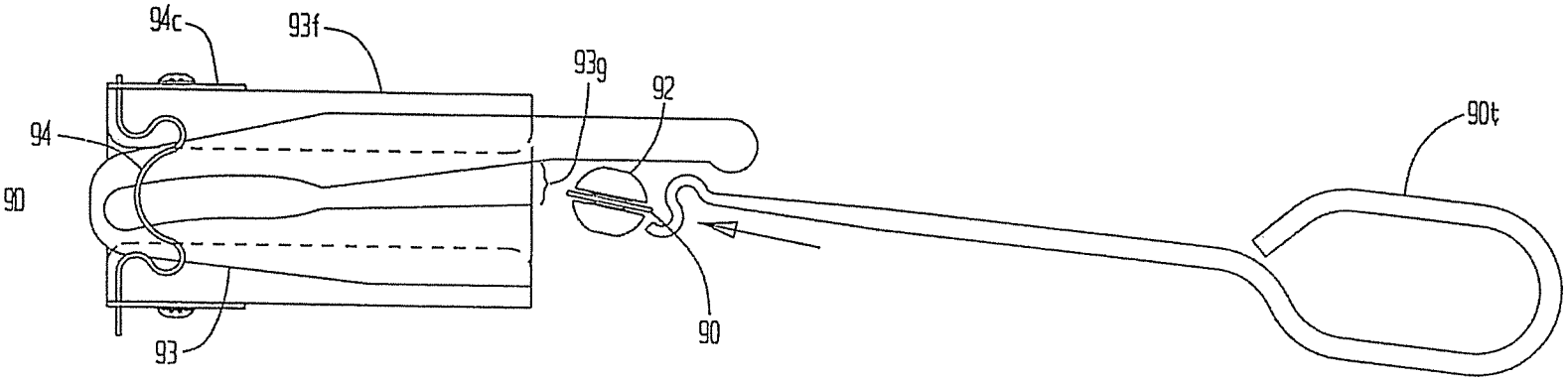
FIG. 9D is a schematic side view of a commercial embodiment of the invention showing the installation of an anvil strip assembly using a push/hook tool to push the anvil strip assembly into its gap or groove.

In FIG. 9C, the anvil strip assembly 90 is shown in a 'kicked out' position in the event a material jam-up or other malfunction has exerted higher than normal forces on the anvil strip assembly 90. The 'kicked-out' position is quasi-static, that is, the anvil strip assembly 90 will stay in the kicked-out position until it is reset, typically by manually pushing the anvil strip assembly 90 towards the left using a tool or tools (one at each end of anvil assembly 90) such as the installation/removal tool 90*t* provided by McMaster Can Supply of Elmhurst, Ill. Other manual or automated means could be provided for resetting anvil strip assembly, such as unlatching levers (not shown), pneumatic cylinders made by Clippard of Cincinnati, Ohio, or solenoid actuators such as supplied by Magnetic Sensor Systems of Van Nuys, Calif.

While particular embodiments of the present invention have been described, it will be obvious to those skilled in the relevant arts that changes and modifications may be made without departing from the invention in its broader aspects. Therefore, the aim in the appended claims is to cover all such changes and modifications that fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A method for rotary pressure cutting a moving source material comprising the steps of:

rotating a cutting cylinder about its longitudinal axis, wherein said cutting cylinder includes a lateral peripheral portion and a cutting blade extending outwardly from said lateral peripheral portion;

positioning a structural member adjacent to, and in spaced relation from, said cutting cylinder, wherein the space between said cutting cylinder and said structural member is adapted to receive the moving source material;

positioning an anvil in the space between said cutting cylinder and said structural member, wherein said anvil is adapted to engage and support the moving source material when the source material is displaced between said cutting cylinder and said structural member;

directing the rotating cylinder's cutting blade into contact with the moving source material, whereupon said moving source material is pressed against said anvil and is severed by said cutting blade, and said anvil is displaced by said cutting blade from a first retracted position to a second activated position;

applying an increasing biasing force to said moving anvil as it is displaced toward said second activated position so as to reverse the movement of said anvil and direct the anvil back to its first retracted position, wherein said biasing force is produced by increasingly bending each of a pair of flexible, resilient members coupled to said anvil as said anvil approaches said second activated position, whereupon release of deflection of said pair of flexible, resilient members causes said flexible, resilient members to return said anvil to said first retracted position in preparation for the next cut of the moving source material; and coupling said anvil to each of said flexible resilient members by means of a respective semispherical ball bearing arrangement for reduced mass and increased reciprocating speeds of said anvil upon release of deflection of said pair of flexible resilient members from a position of greater bending to a position of reduced bending.

2. The method of claim 1, wherein deflection of said flexible, resilient members and the associated biasing force exerted on the anvil increases as the anvil approaches the second activated position.

3. The method of claim 2 further comprising the step of providing each of said flexible, resilient members in the form of an elongated leaf spring or a cantilever spring.

4. The method of claim 3, wherein said semispherical ball bearing arrangements guide said anvil along a path defined by said leaf springs or said cantilever springs.

5. The method of claim 1, wherein said flexible, resilient members allow said anvil to over-travel said cutting blade in the direction of said second activated position so as to more securely engage said anvil with said flexible, resilient members and maintain said anvil in a quasi-stable position to avoid said cutting blade in the event of a jam-up.

6. The method of claim 5 further comprising the step of retaining said anvil in said over-travel position followed by returning said anvil to said first retracted position upon release of deflection of said flexible, resilient members.

7. The method of claim 1, wherein the step of increasingly deflecting each of said flexible, resilient members includes bending each of said flexible, resilient members in two planes.

8. The method of claim 1 further comprising the step of providing each of said flexible, resilient members with a selected contour along a portion of the length of said flexible, resilient member, wherein said flexible, resilient member's selected contour determines its progressive spring rate.

9. The method of claim 1, wherein said semispherical ball bearing arrangements stabilize said anvil in pitch as said anvil is displaced on said flexible, resilient members.

10. The method of claim 1 further comprising the step of applying a selective force to said anvil in displacing said anvil from said second activated position to said first retracted position by providing the pair of flexible, resilient members with selected dimensions, including the thickness of each of said flexible, resilient members.

11. The method of claim 1 further comprising a step of adjusting the position of said pair of flexible, resilient members relative to said anvil for changing the deflection of said flexible, resilient members and the force applied to the anvil in displacing the anvil from said second activated position to said first retracted position.

* * * * *